US005884371A

United States Patent [19]

Huggins

[11] Patent Number: 5,884,371

[45] Date of Patent: Mar. 23, 1999

[54] LOWER GARMENT SUSPENSION APPARATUS FOR ASSISTING DISABLED PERSONS IN DRESSING

[76] Inventor: Cynthia L. Huggins, 1940 S. Westmount Dr., Tucson, Ariz. 85713

[21] Appl. No.: 918,150

[22] Filed: Aug. 25, 1997

[51] Int. Cl.[6] ..... A44B 21/00; A41F 1/00

[52] U.S. Cl. ..... 24/300; 24/511; 24/301; 24/298

[58] Field of Search ..... 24/300–303, 501, 24/511, 530, 545, 564, 461, 331, 332, 334, 335, 338, 30.5 R, 66.4, 489

[56] References Cited

U.S. PATENT DOCUMENTS

| | | | |
|---|---|---|---|
| 202,735 | 4/1878 | Lindsay | 24/331 X |
| 867,814 | 10/1907 | Fornander | 24/298 X |
| 1,782,057 | 11/1930 | Bollinger | 24/332 X |
| 1,929,683 | 10/1933 | Ellinger | 24/301 |
| 2,454,723 | 11/1948 | Stinne | 24/500 X |
| 3,727,272 | 4/1973 | Rhodes | 24/331 X |
| 4,394,791 | 7/1983 | Groth | 24/30.5 R |
| 4,937,886 | 7/1990 | Ellis . | |
| 4,945,613 | 8/1990 | Ledermann | 24/511 X |
| 5,063,645 | 11/1991 | Crespo | 24/511 X |
| 5,172,429 | 12/1992 | Lucier . | |
| 5,177,813 | 1/1993 | Bosack et al. . | |
| 5,177,814 | 1/1993 | Courtney . | |
| 5,267,374 | 12/1993 | Drake . | |
| 5,276,923 | 1/1994 | Cohen . | |
| 5,313,669 | 5/1994 | Rasdell et al. . | |
| 5,375,301 | 12/1994 | Schindler | 24/66.4 |
| 5,457,858 | 10/1995 | Lin | 24/511 |
| 5,621,955 | 4/1997 | Schmid et al. | 24/511 |
| 5,655,270 | 8/1997 | Boisvert | 24/301 X |

*Primary Examiner*—Anthony Knight
*Assistant Examiner*—Robert J. Sandy
*Attorney, Agent, or Firm*—Jean M. Barkley; Antonio R. Durando

[57] ABSTRACT

A dressing aid for suspending a lower garment from an upper garment is disclosed herein comprising a band and a pair of clips, with one clip connected to each end of the band. Each clip comprises a pair of arms each having a handle at a first end and a jaw at a second end, a pivoting means, and a means for biasing the jaws to the closed position. One may engage a garment using the clip by squeezing together the handles such that the jaws separate, then releasing the handles to close the jaws about a garment positioned therebetween. It is contemplated that one will employ the present apparatus to aid in donning a lower garment using the following steps: assuming a seated position with the lower garment pulled up past one's knees; manually squeezing the handles of one clip together to separate its jaws, positioning the jaws about a portion of the upper garment and then releasing the handles to close the jaws and engage the upper garment; manually squeezing the handles of the other clip together to separate its jaws and to likewise engage a portion of the lower garment; and finally standing erect, with the lower garment suspended from said upper garment, and fastening the lower garment into place.

17 Claims, 4 Drawing Sheets

LOWER GARMENT SUSPENSION APPARATUS FOR ASSISTING DISABLED PERSONS IN DRESSING

TECHNICAL FIELD

The present invention relates to devices for assisting disabled persons in dressing, and more particularly, to an apparatus for holding a lower garment in suspension until it can be properly secured.

BACKGROUND ART

A common challenge for those persons afflicted with physically disabling conditions is the performance of daily tasks such as dressing oneself For example, a stroke victim having some degree of paralysis or weakness may experience difficulty in putting on a lower garment, such as a pair of pants or a skirt. The task of putting on one's pants requires one to accomplish a number of activities almost simultaneously, namely standing while grasping the top edge of the article of clothing and maintaining that grasp while fastening the article of clothing, such as by zipping and buttoning a pair of pants. A disabled person may find any one or all of these activities difficult, let alone their near simultaneous accomplishment. One common scenario is that a person may be able to stand up while grasping the garment, but then has difficulty maintaining his or her balance and experiences the garment sliding down when trying to fasten the article.

Various apparatuses are disclosed that secure articles of clothing in the desired position. For example, apparatuses for holding down one's shirt are known. Illustrative of that class of apparatuses is U.S. Pat. No. 4,937,886, issued to Ellis on Jul. 3, 1990 and entitled "*Infant Shirt Hold-Down*", which teaches an apparatus comprising a wide, elongated elasticized section from which extends a pair of straps from each end thereof, with an operable fastener being provided at the end of each strap. The apparatus is intended to hold down a child's upper garment, such as a shirt. Ellis teaches that the apparatus is passed between the child's legs and the strap fasteners are fastened to the lower edges of the upper garment. Other disclosures of similar apparatuses include U.S. Pat. No. 5,177,813, issued to Bosack and entitled "*Shirttail Retaining Harness*"; U.S. Pat. No. 5,177,814, issued to Courtney and entitled "*Shirt Retainer*"; and U.S. Pat. No. 5,276,923, issued to Cohen and entitled "*Shirt Hold-Down Device*"

The above-described references related to shirttail retaining apparatuses do not disclose a device that would assist a disabled person in donning a lower garment, but simply relate to securing an upper garment. Moreover, the fastening mechanisms contemplated for use with the shirttail retaining apparatuses are garter clips or jawed hinge clips, which require more dexterity than fastening an article of clothing and would offer no help to a disabled person attempting to clothe himself In contradistinction from the above-described devices, suspenders or suspender-like devices are known for holding up trousers or lower garments, rather than holding down upper garments. A disclosure for suspenders is found in U.S. Pat. No. 5,172,429, issued to Lucier and assigned on its face to New England Accessories. Therein, Lucier discloses combination suspenders having interchangeable clip ends and button strap ends connected to the suspender straps for use with either button or buttonless trousers. While suspenders such as disclosed by Lucier are useful in supporting a lower garment, the clips contemplated for engaging the lower garment are jawed hinged clips which are openable and closeable via a latching lever. Like garter clips, jawed hinged clips require one to position the clothing between the jaws and then secure the clothing by engaging a lever, which is a two-step process that disabled persons might find difficult or impossible to complete.

U.S. Pat. No. 5,313,669, issued to Rasdell et al. and entitled "*Clothing Anchor Apparatus*", teaches an apparatus for securing clothing in position, and is particularly contemplated to anchor the front and back tails of shirts. The apparatus includes an elastic strap at each end of which is a clothing connector. The clothing connector disclosed by Rasdell et al. comprises a female connector member and a male connector member, such that the user must position the garment therebetween and then latch the male connector member into the upper rim of the female connector. Again, a disabled person might find the steps of positioning the garment within the connectors and latching the connectors to be onerous.

The clips employed by each of the above-described apparatuses therefore require a combination of steps for engagement that a disabled person might find prohibitive. However, there are certain types of clips that would present less difficulty in engaging than garter clips or jawed hinge clips. For example, U.S. Pat. No. 5,267,374, issued to Drake and entitled "*Closure Clip for Plastic Bags and Similar Articles*", discloses a hinged clip that is operated by simply manually squeezing together the arms of the clip to open its jaws then releasing to close the jaws. However, this type of hinged clip would not be useful underneath clothing because of its bulky shape. An example of a commercially available hinged clip operable by squeezing together the arms of the clip is the "Chip Clip®", which is intended for use in closing potato chip bags.

It would be desirable to develop a lower garment suspension apparatus employing hinged clips that could be more readily operated by disabled persons than the garter clips commonly employed in suspenders, for example. The apparatus should be of simple and durable construction, with the hinged clips requiring a minimal amount of strength to open yet capable of firmly holding clothing when engaged.

DISCLOSURE OF INVENTION

In accordance with the invention, a dressing aid for suspending a lower garment from an upper garment is provided. The dressing aid comprises a band and a pair of clips, with one clip connected to each end of the band. Each clip comprises a pair of arms each having a handle at a first end and a jaw at a second end, a pivoting means, and a means for biasing the arms to the closed position. One may engage a garment using the clip by squeezing together the handles such that the jaws separate, then releasing the handles to close the jaws about a garment positioned therebetween. A method of suspending a lower garment using this apparatus is also provided herein, whereby one engages an upper garment with one clip and the lower garment with the opposing clip so that the lower garment is effectively suspended from the upper garment by the band.

A method of donning a lower garment using the present dressing aid is provided herein comprising the following steps: assuming a seated position with the lower garment pulled up past one's knees; manually squeezing the handles of one clip together to separate its jaws, positioning the jaws about a portion of the upper garment and then releasing the handles to close the jaws and engage the upper garment; manually squeezing the handles of the other clip together to separate its jaws and to likewise engage a portion of the lower garment; and finally standing erect, with the lower garment suspended from the upper garment, and fastening the lower garment into place.

The present dressing aid and methods therefore offer certain disabled persons a means by which they can dress themselves that is relatively inexpensive, simple, and durable.

BEST MODES FOR CARRYING OUT THE INVENTION

In accordance with the invention, a lower garment suspension apparatus is provided that comprises a band at each end of which is connected a clip. Each clip comprises a pair of arms each having a handle at a first end and a jaw at a second end, a pivoting means, and a means for biasing the jaws to the closed position. It is contemplated that one will engage the upper garment with one clip and the lower garment with the other clip, so that the lower garment is suspended from the upper garment via the band.

Figure 1:
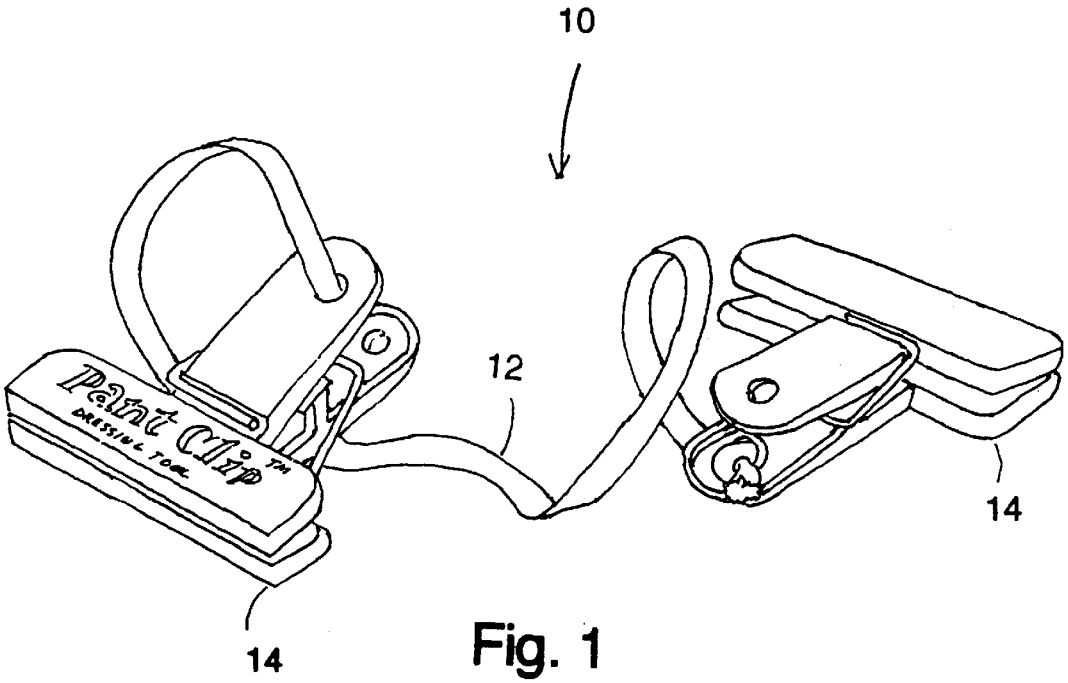
FIG. 1 is a perspective view showing a preferred embodiment of the present dressing aid.

The invention will be better understood with reference to the drawings, in which like numbers represent like parts throughout the several views. Turning now to FIG. 1, a perspective view of the preferred embodiment of the dressing aid 10 is depicted. The dressing aid 10 comprises a band 12 with clips 14 at the opposing ends thereof The band 12 is particularly contemplated to be in the form of a cord. It may comprise any conventional material that is durable and flexible, such as cloth, leather, plastic, and elastic materials. Preferably, the band 12 is a nylon cord, such as comprising 70% nylon and 30% polypropylene.

The band 12 is contemplated to have a length within the range of about 20 to 23 inches, and preferably has a length of about 21 inches. The band 12 could be made so that its length is adjustable by means of a series of strap adjusters serving to decrease the effective length of a band by doubling the band upon itself, such as described in U.S. Pat. No. 5,313,669, col. 4, line 24 through col. 5, line 8, that portion of which is herein incorporated. However, it is preferred that the band comprise a single piece of material without the use of strap adjusters to preserve the simplicity of the present article. An adjustment to the length of the band 12 can be achieved by simply tying the band 12 to the each clip 14 so that only the desired length of band links the clips 14 together.

The type of clips 14 employed in the practice of the invention represents a primary inventive feature of the present dressing aid 10. The clips 14 employed in the present dressing aid 10 must require only minimal strength and dexterity to operate, and must be operable with a single hand, as opposed to garter clips and other clips employed in the clothing industry to provide smooth profiles underneath clothing. The present clips 14 meet this requirement by requiring only the act of manually squeezing and then releasing the clip 14 to engage a garment. Specifically referring to FIG. 2A, the clips 14 are contemplated to be a substantially identical pair each comprising a pair of arms 16 each having a handle 18 at a first end and a jaw 20 at a second end. Thus, the present clips 14 are employed to engage a garment by simply manually squeezing the handles 18 to open the jaws 20 about a portion of a garment and then releasing the handles 18 to allow the jaws 20 to close, thereby securely gripping the portion of garment. While the clips 14 may comprise any sufficiently durable material, it is preferred that the clips comprise a plastic material for ease of manufacture.

Figure 2A:
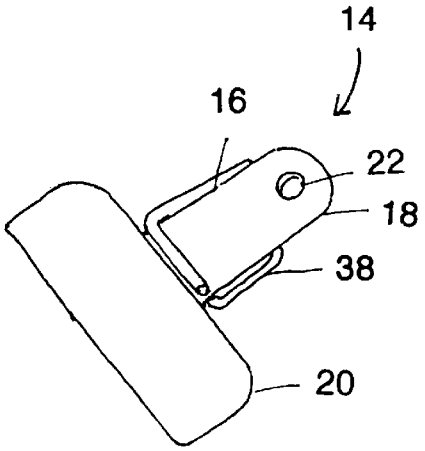
FIG. 2A is a top plan view of the preferred embodiment of the clip at each end of the present dressing aid.

Preferably, the clip 14 has a T-shape from a top plan view, as depicted in FIG. 2A, with such clips being operable with a single hand and with minimal strength and dexterity. This T-shaped clip is commercially available as clips for closing plastic bags, such as potato chip bags (e.g., the "Chip Clip®"). However, it is noted that any clip operable by simply manually squeezing the clip and then releasing the clip to engage a garment may be suitably employed in the practice of the invention. For example, a conventional hinged clothespin (not shown) used for hanging clothes on a line to dry would suffice in the practice of the invention, although the T-shaped design of the clip 14 in FIG. 2A provides greater areal engagement of a garment for a more secure hold and the handles 18 of the T-shaped design clips are wider and more easily grasped.

Figure 2B:
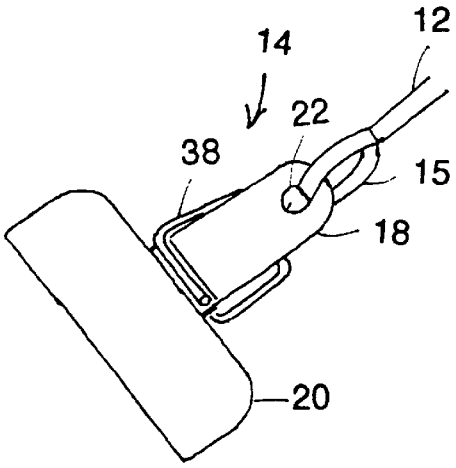
FIG. 2B is a top plan view of an embodiment of the connection between the clip and the band in which the band has a loop that engages an opening in the clip for a connection therebetween.

While any means of securely connecting the clip 14 to the band 12 is acceptable in the practice of the invention, it is preferred that the clip 14 have an opening 22 in its handle such that the band can be journaled therethrough and tied to the clip 14, as shown in FIG. 1. In this fashion, the user can easily control the length of the band 12 by tying the band 12 so as to leave the desired length of band 12 to connect the clips 14. Among other options for connecting the clip 14 to the band 12, the connection can also be achieved via sewing the band 12 back onto itself to form a loop 15 that engages the opening 22, as shown in FIG. 2B.

Figure 3:
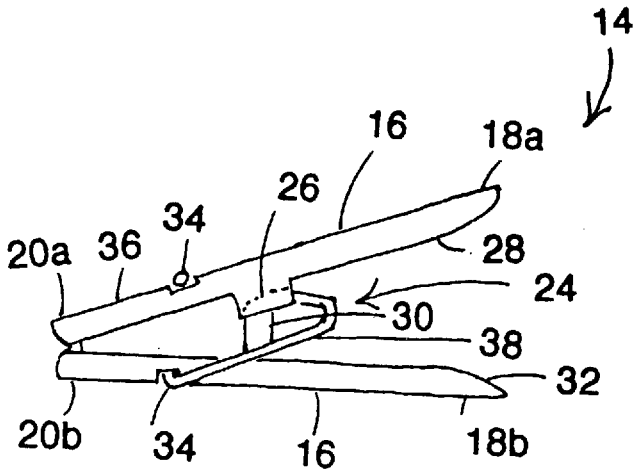
FIG. 3 is a side elevational view of the clip depicted in FIG. 2 in a closed position, with dashed lines showing the transverse curved slot and the transverse curved member extending into the slot.
Figure 4:
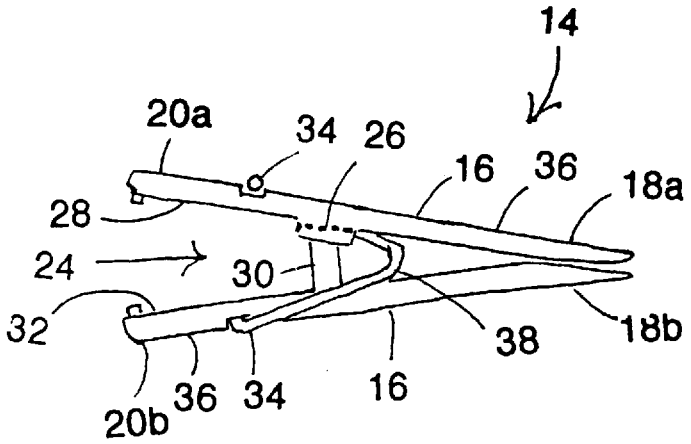
FIG. 4 is a side elevational view of the clip depicted in FIG. 2 in an open position, with dashed lines showing the transverse curved slot and the transverse curved member extending into the slot.
Figure 5:
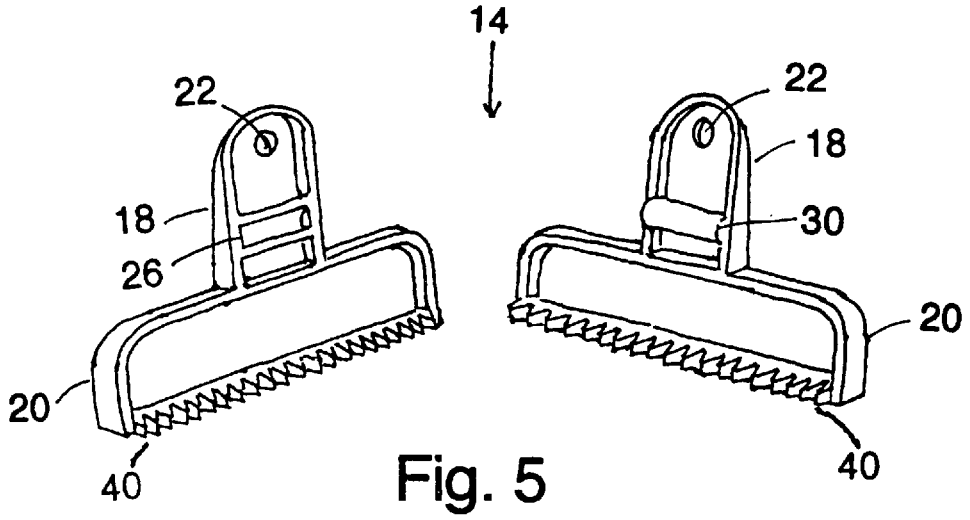
FIG. 5 is a diagrammatic perspective view showing each half of a clip with the hinge traversing the width of the handle.
Figure 6:
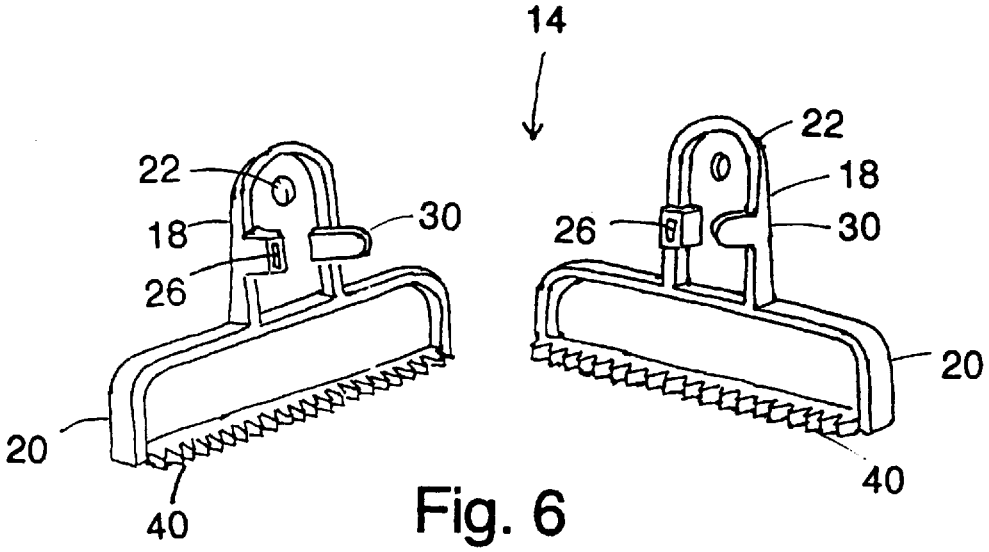
FIG. 6 is a diagrammatic perspective view showing each half of a clip with the hinge comprising a pair of hinges.

Turning now to FIG. 3, a clip 14 useful in the practice of the invention is depicted in its closed or "at rest" position, with its jaws 20*a,b* together. A pivoting means 24 is provided in the practice of the invention to enable the jaws 20*a,b* to open once the handles 18*a,b* are manually squeezed together. In the preferred embodiment, the pivoting means 24 includes a curved slot 26 (shown in dashed lines in FIG. 3) on the inner surface 28 of handle 18*a*, and a curved member 30 on the inner surface 32 of handle 18*b* extendable into the slot 26. When the handles 18*a,b* are squeezed together, the curved member 30 rounds through the curved slot 26 to serve as a hinge, as shown in dashed lines in FIG. 4. The curved slot 26 may transverse the width of the handle 18*a*, being paired with a curved member 30 that likewise transverses the width of the handle 18*b*, as shown in FIG. 5. More preferably, a plurality of slots 26 and curved members 30 are employed in the practice of the invention, most preferably a pair of slots 26 are engaged by an opposing pair of curved members 30, as shown in FIG. 6.

The clip 14 employed in the practice employs a means for biasing its arms 16 so that the jaws 20 remain in the closed position as depicted in FIG. 3 in the absence of pressure on the handles 18. While any means for biasing the arms 16 might be employed, it is preferred that the means comprise at least one transverse groove 34 on the outer surface 36 of the arm 16 between the handle 18 and the jaw 20, as shown in FIGS. 3 and 4. A resilient tension element 38 engages the transverse groove 34 so that the jaws 20*a,b* are normally biased together. The resilient tension element 38 may comprise any durable material with sufficient strength and plasticity, such as metal, rubber, or elastic materials, but is specifically contemplated to be metal.

Figure 7:
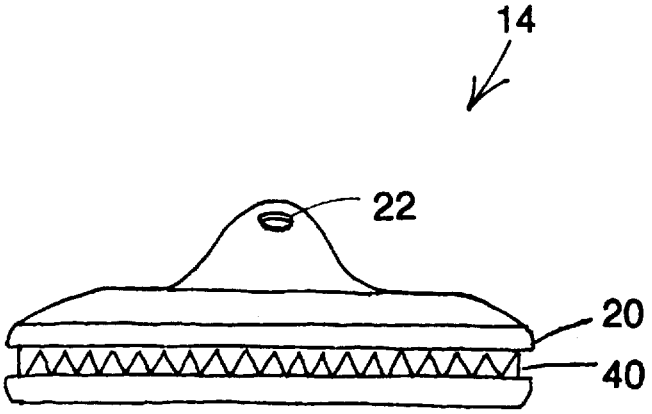
FIG. 7 is a front elevational view of the jaws of the clip depicted in FIG. 2.

It is contemplated that each jaw will contain a plurality of teeth 40 to increase the frictional engagement of the garment. FIG. 7 depicts in a front view of the clip 14 the interdigitation of the teeth 40. It is noted that the frictional force will increase with the number of teeth as well as with the degree of protrusion by the teeth 40 into the garment. These factors can be altered as desired. It is considered routine for those having ordinary skill in the art to optimize the number of teeth 40 and their degree of protrusion, balancing the need for a secure hold of the garment with the likelihood of damaging the garment if the teeth 40 are too sharp or protrusive.

Figure 8A:
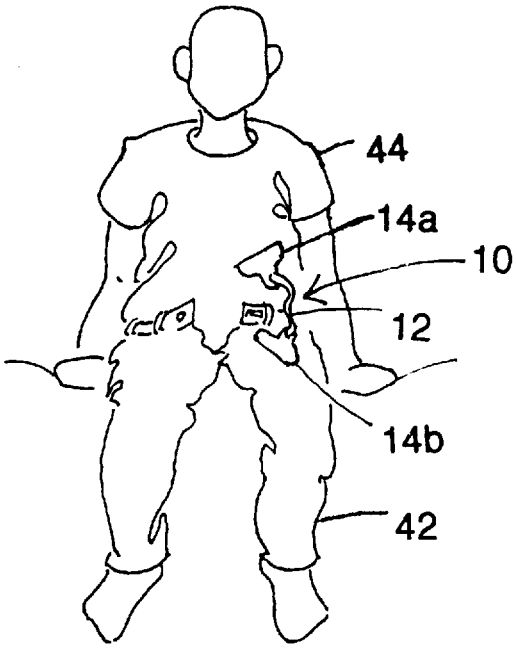
FIG. 8A illustrates the present dressing aid being engaged to connect the upper and lower garments when an individual is sitting.

As contemplated for use, the dressing aid 10 is employed to suspend a lower garment 42 from an upper garment 44 (see FIG. 8A). To employ the dressing aid 10, it is contemplated that one will grasp one of the clips 14*a*, depress the handles 18*a,b* of the clip together, and engage the upper garment 44 by releasing the handles 18*a,b* about a portion of the garment. The user will then grasp the opposing clip 14*b* and likewise depress its handles 18*a,b* to engage the lower garment 42. In this fashion, the lower garment 42 may be suspended from the upper garment 44 should the individual stand. It is noted that the order by which the lower garment 42 and the upper garment 44 are engaged by the clips 14 is not fixed; the upper and lower garments 42,44 may be secured by the clips 14 in any order. Furthermore, one may use a plurality of dressing aids 10 to suspend a lower garment 42 from an upper garment 44; for example, one may employ a pair of dressing aids 10, with one dressing aid 10 being used on each side of the individual's clothing for a more balanced suspension of the lower garment 42.

Figure 8B:
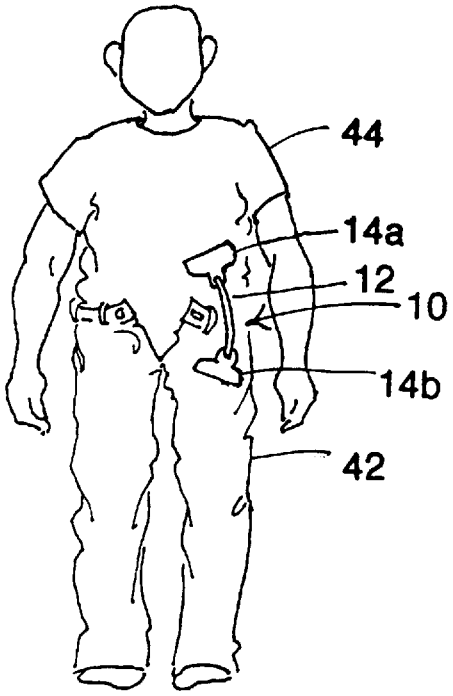
FIG. 8B illustrates the present dressing aid serving to suspend the lower garment, namely the trousers, of an individual who is standing.

It is contemplated that the present lower garment suspension apparatus 10 will be used as a dressing aid by persons who are disabled and have difficulty in dressing themselves. With the present apparatus, the user would sit down and pull the lower garment 42, shown in FIG. 8A as trousers, over his knees. The user would then attach one clip 14*a* of the present dressing aid 10 to his upper garment 44 and the opposing clip 14*b* to the lower garment 42, as depicted in FIG. 8A, with the clip 14*a* preferably being operable with a single hand. In this fashion, when the user stands to pull up the trousers 42 as depicted in FIG. 8B, the present dressing aid 10 suspends the trousers from the upper garment 44 so that the trousers do not fall back to the floor before being secured such as by a zipper and button enclosure. Thus, the present dressing aid 10 separates the steps required for donning a lower garment 42 so that a disabled person can accomplish each step separately in his own time, rather than having to simultaneously hold up the lower garment while standing and securing the garment.

Thus, there has been disclosed a dressing aid, a method of suspending a lower garment from an upper garment, and method of donning a lower garment. It will be readily apparent to those skilled in the art that various changes and modifications of an obvious nature may be made without departing from the spirit of the invention, and all such changes and modifications are considered to fall within the scope of the invention as defined by the appended claims.

What is claimed is:

1. A dressing aid for suspending a lower garment from an upper garment, said dressing aid comprising a band, a first clip, and a second clip, said band having a first end and a second end, said first end connected to said first clip and said second end connected to said second clip, each said clip comprising:

(a) a pair of arms each having a handle at a first end and a jaw at a second end, said handle being substantially perpendicular to said jaw, said saw having a mid-point along its length and said handle joining said law at said mid-point so that each said arm has a T-shape, said Jaw including a plurality of interdigitating teeth along its elongated portion;

(b) a pivoting means; and (c) a means for biasing said arms to the closed position, said arms having an inner surface and an outer surface, whereby when said handles are manually squeezed together said jaws will separate to receive said garment therebetween.

2. The dressing aid of claim 1 wherein said band is a cord.

3. The dressing aid of claim 2 wherein said handle of said clips has an opening of sufficient diameter to receive said cord, whereby said clip is connected to said cord by journaling said cord through said opening and tying said cord about said handle.

4. The dressing aid of claim 1 wherein said pivoting means includes at least one transverse curved slot on said inner surface of said first arm adjacent said handle to form at least one female socket, and said second arm having at least one transverse curved member on its inner surface adjacent said handle to form a male protrusion, said transverse curved member engaging said transverse curved slot to form a hinge.

5. The dressing aid of claim 1 wherein said means for biasing said arms to the closed position includes each said arm having at least one transverse groove on its outer surface between said handle and said jaw, and a resilient tension element for engaging with said at least one transverse groove on each said arm so that said jaws are normally biased together.

6. A method of suspending a lower garment from an upper garment to enable one to fasten said lower garment while suspended, said method comprising:

(a) providing an apparatus comprising a band, a first clip, and a second clip, said band having a first end and a second end, said first end connected to said first clip and said second end connected to said second clip, each said clip comprising a pair of arms each having a handle at a first end and a jaw at a second end, a pivoting means, and a means for biasing said arms to the closed position, said arms having an inner surface and an outer surface, whereby when said handles are manually squeezed together said jaws will separate to receive said garment therebetween;

(b) manually squeezing said handles of said first clip together to separate said jaws;

(c) positioning said separated jaws of said first clip to envelop therebetween a portion of said upper garment;

(d) releasing said handles of said first clip to close said jaws about said portion of said upper garment;

(e) manually squeezing said handles of said second clip together to separate said jaws;

(f) positioning said separated jaws of said second clip to envelop therebetween a portion of said lower garment; and (g) releasing said handles of said second clip to close said jaws about said portion of said lower garment, whereby said lower garment will be suspended from said upper garment once one wearing said garments stands erect.

7. The method of claim 6 wherein said band is a cord.

8. The method of claim 7 wherein said handle of said clips has an opening of sufficient diameter to receive said cord, whereby said clip is connected to said cord by journaling said cord through said opening and tying said cord about said handle.

9. The method of claim 6 wherein each said arm has a T-shape, with said handle being substantially perpendicular to said jaw, said jaw having a mid-point along its length and said handle joining said jaw at said mid-point to form said arm.

10. The method of claim 6 wherein said jaw includes a plurality of teeth along its elongated portion.

11. The method of claim 10 wherein said teeth are interdigitating.

12. The method of claim 6 wherein said pivoting means includes at least one transverse curved slot on said inner surface of said first arm adjacent said handle to form at least one female socket, and said second arm having at least one transverse curved member on its inner surface adjacent said handle to form a male protrusion, said transverse curved member engaging said transverse curved slot to form a hinge.

13. The method of claim 6 wherein said means for biasing said arms to the closed position includes each said arm having at least one transverse groove on its outer surface between said handle and said jaw, and a resilient tension element for engaging with said at least one transverse groove on each said arm so that said jaws are normally biased together.

14. A method of donning a lower garment having already donned an upper garment, said method comprising:

(a) providing an apparatus comprising a band, a first clip, and a second clip, said band having a first end and a second end, said first end connected to said first clip and said second end connected to said second clip, each said clip comprising a pair of arms each having a handle at a first end and a jaw at a second end, a pivoting means, and a means for biasing said arms to the closed position, said arms having an inner surface and an outer surface, whereby when said handles are manually squeezed together said jaws will separate to receive said garment therebetween;

(b) assuming a seated position with one's knees bent;

(c) pulling said lower garment up past the knees;

(d) manually squeezing said handles of said first clip together to separate said jaws;

(e) positioning said separated jaws of said first clip to envelop therebetween a portion of said upper garment;

(f) releasing said handles of said first clip to close said jaws about said portion of said upper garment;

(g) manually squeezing said handles of said second clip together to separate said jaws;

(h) positioning said separated jaws of said second clip to envelop therebetween a portion of said lower garment;

(i) releasing said handles of said second clip to close said jaws about said portion of said lower garment; and (j) standing erect so that said lower garment is suspended from said upper garment and fastening said lower garment into place.

15. The method of claim 14 wherein said band is a cord and wherein said handle of said clips has an opening of sufficient diameter to receive said cord, whereby said clip is connected to said cord by journaling said cord through said opening and tying said cord about said handle.

16. The method of claim 14 wherein said pivoting means includes at least one transverse curved slot on said inner surface of said first arm adjacent said handle to form at least one female socket, and said second arm having at least one transverse curved member on its inner surface adjacent said handle to form a male protrusion, said transverse curved member engaging said transverse curved slot to form a hinge.

17. The method of claim 14 wherein said means for biasing said arms to the closed position includes each said arm having at least one transverse groove on its outer surface between said handle and said jaw, and a resilient tension element for engaging with said at least one transverse groove on each said arm so that said jaws are normally biased together.

* * * * *

UNITED STATES PATENT AND TRADEMARK OFFICE

CERTIFICATE OF CORRECTION

PATENT NO : 5,884,371

DATED : March 23, 1999

INVENTOR(S) : Cynthia L. Huggins

It is certified that error appears in the above-identified patent and that said Letters Patent is hereby corrected as shown below:

In Claim 1, column 6, line 26, replace the word "law" with --jaw--

In Claim 1, column 6, line 27, replace the word "Jaw" with --jaw--

Signed and Sealed this

Seventh Day of September, 1999

*Attest:*

Q. TODD DICKINSON

*Attesting Officer*

*Acting Commissioner of Patents and Trademarks*